US008672083B2

(12) United States Patent
Lee

(10) Patent No.: US 8,672,083 B2
(45) Date of Patent: Mar. 18, 2014

(54) TOOL FOR REMOTELY OPERATING A VEHICLE'S IGNITION

(71) Applicant: Tony Alan Lee, Springfield, MO (US)

(72) Inventor: Tony Alan Lee, Springfield, MO (US)

( * ) Notice: Subject to any disclaimer, the term of this patent is extended or adjusted under 35 U.S.C. 154(b) by 0 days.

(21) Appl. No.: 13/665,752

(22) Filed: Oct. 31, 2012

(65) Prior Publication Data

US 2013/0104690 A1 May 2, 2013

Related U.S. Application Data

(60) Provisional application No. 61/553,820, filed on Oct. 31, 2011.

(51) Int. Cl.
*B60K 26/04* (2006.01)

(52) U.S. Cl.
USPC ..... 180/315; 74/501.5 R; 74/501.6; 74/505

(58) Field of Classification Search
USPC ..... 180/315; 74/500.5, 501.5 R, 501.6, 505, 74/506
See application file for complete search history.

(56) References Cited

U.S. PATENT DOCUMENTS

| | | | | |
|---|---|---|---|---|
| 3,507,259 | A * | 4/1970 | Lankford | 123/179.2 |
| 4,036,040 | A * | 7/1977 | Graizzaffi | 70/431 |
| 6,701,760 | B1 * | 3/2004 | Elliason | 70/256 |
| 6,877,347 | B2 * | 4/2005 | Elliason | 70/256 |
| 8,534,676 | B2 * | 9/2013 | Whisenand et al. | 279/5 |

* cited by examiner

*Primary Examiner* — Paul N Dickson
*Assistant Examiner* — Robert A Coker

(57) ABSTRACT

A tool can be attached to a vehicle key in the ignition switch of a vehicle and the operator can turn on the key, crank the engine, bump start, or turn off the engine. These operations can be performed while the operator is under the hood, for example, by operating a cable pull and release unit. The tool can be used to turn the ignition switch on to perform various diagnostic and vehicle lighting tests. The tool includes a hand held control unit that moves a cable within a housing when the handles of the control unit are squeezed from an initial position, toward each other. The cable causes a key turner to turn. A spring-loaded return mechanism causes the key turner to turn the key in reverse (in an off position) when the handles of the hand held control unit are moved back to the initial position.

14 Claims, 6 Drawing Sheets

TOOL FOR REMOTELY OPERATING A VEHICLE'S IGNITION

CROSS-REFERENCE TO RELATED APPLICATION

This application claims the benefit of priority of U.S. provisional application No. 61/553,820, filed Oct. 31, 2011, the contents of which are herein incorporated by reference.

BACKGROUND OF THE INVENTION

The present invention relates to mechanic's tools and, more particularly, to a tool for remotely operating a vehicle's ignition, such as operating a vehicle ignition key functions from within a hood area of the vehicle.

When working on vehicles, it is often necessary to have a helper turn the ignition key to crank or bump the engine over to check for cranking issues, firing issues or diagnostic tests. An assistant, however, is not always available. Even if available, an assistant may not perform effectively.

Conventional push button tools which hook up to the starter solenoid or relay can be difficult to use, as access may be confined and it can be difficult to trace what wires to hook these devices up to. Moreover, these conventional devices also don't turn off the engine. Other conventional devices that can be used to remotely start an engine use air pressure to operate. They need air pressure and hosing can be problematic to coil and uncoil. These units require significant storage space and take longer to access air hose, longer to hook up the air hose and longer to attach the tool to the vehicle and make it operate. For vehicles that require the key to be pushed in, these conventional devices do not have a provision for such pressing in of the key prior to turning.

As can be seen, there is a need for a remote ignition turning device that can turn a vehicle's ignition on and off with a simple to use and quick to set up device.

SUMMARY OF THE INVENTION

In one aspect of the present invention, a remote ignition key turning device comprises a key holder; a pulley plate connected to the key holder wherein rotation of the pulley plate causes rotation of the key holder; a cable having a first end disposed about an outer periphery of the pulley plate and extending therefrom; a hand held control unit having a hand held unit pulley plate secured to a second, opposite end of the cable; a first handle of the hand held control unit attached to the hand held unit pulley plate; a second handle of the hand held control unit attached to a case of the hand held control unit; and a resilient pulling mechanism attached to the pulley plate, the resilient pulling mechanism applying a force to turn the pulley plate in a first rotational direction, wherein moving the first handle toward the second handle causes the cable to be pulled, thereby turning the pulley plate in a second, opposite rotational direction against the force of the resilient pulling mechanism.

In another aspect of the present invention, a remote ignition key turning device comprises a key holder; a pulley plate connected to the key holder wherein rotation of the pulley plate causes rotation of the key holder; a cable having a first end disposed about an outer periphery of the pulley plate and extending therefrom; a hand held control unit having a hand held unit pulley plate secured to a second, opposite end of the cable; a first handle of the hand held control unit attached to the hand held unit pulley plate; a second handle of the hand held control unit attached to a case of the hand held control unit; an extension rod supporting the pulley plate disposed in a pulley case; an alignment rod attached to a pulley case disposed about the pulley plate; and a pulley return tension cable attached to the pulley plate, the pulley return tension cable attached to a spring disposed in the extension rod, the spring applying a force to turn the pulley plate in a first rotational direction, wherein moving the first handle toward the second handle causes the cable to be pulled, thereby turning the pulley plate in a second, opposite rotational direction against the force of the resilient pulling mechanism.

These and other features, aspects and advantages of the present invention will become better understood with reference to the following drawings, description and claims.

DETAILED DESCRIPTION OF THE INVENTION

Figure 1:
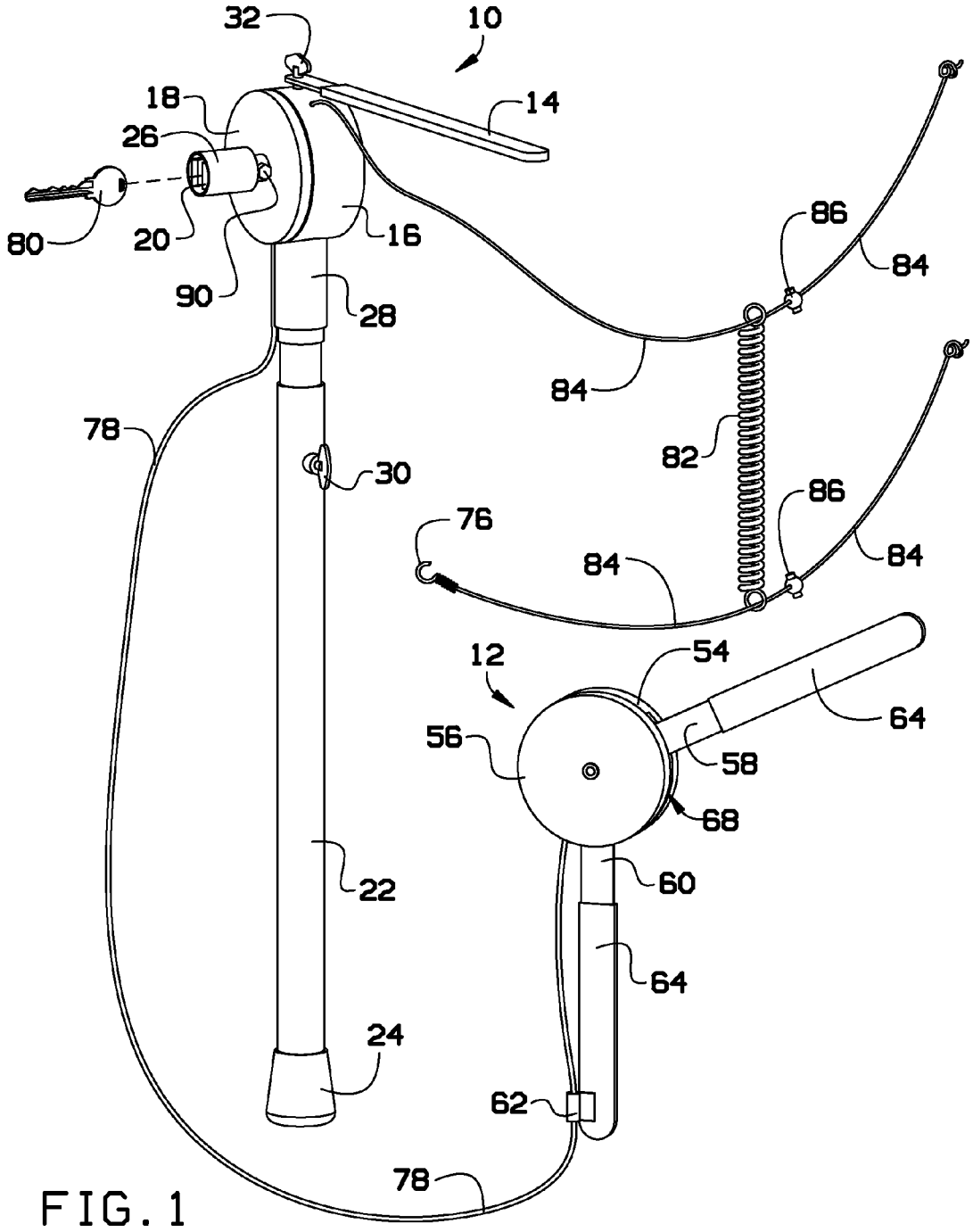
FIG. 1 is a perspective view of a remote ignition key turning device, in its initial state, according to an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a tool for remotely turning an ignition key of a vehicle. The tool can be attached to a vehicle key in the ignition switch and the operator can turn on the key, crank the engine, bump start, or turn off the engine. These operations can be performed while the operator is under the hood, for example, by operating a cable pull and release unit. The tool can be used to turn the ignition switch on to perform various diagnostic and vehicle lighting tests. The tool includes a hand held control unit that moves a cable within a housing when the handles of the control unit are squeezed from an initial position, toward each other. The cable causes a key turner to turn and a spring-loaded return mechanism can cause the key turner to turn the key in reverse (in an off position) when the handles of the hand held control unit are moved back into an initial position.

The device includes a spring and cord unit for pushing in on keys for those keys that require pushing in before use.

Referring now to FIGS. 1 through 7, a remote ignition key turning device 10 (also referred to as a key twist unit 10) can include a key holder 20 disposed within a sleeve 26 that can turn a key 80 as a cable 52 transfers input from a control handle 12 actuated by an operator 50. The cable 52 includes a sleeve 78 encasing the cable 52, where the cable 52 can move within the sleeve 78 when the operator 50 moves handles 58, 60 of the control handle 12 together, as described below.

Figure 2:
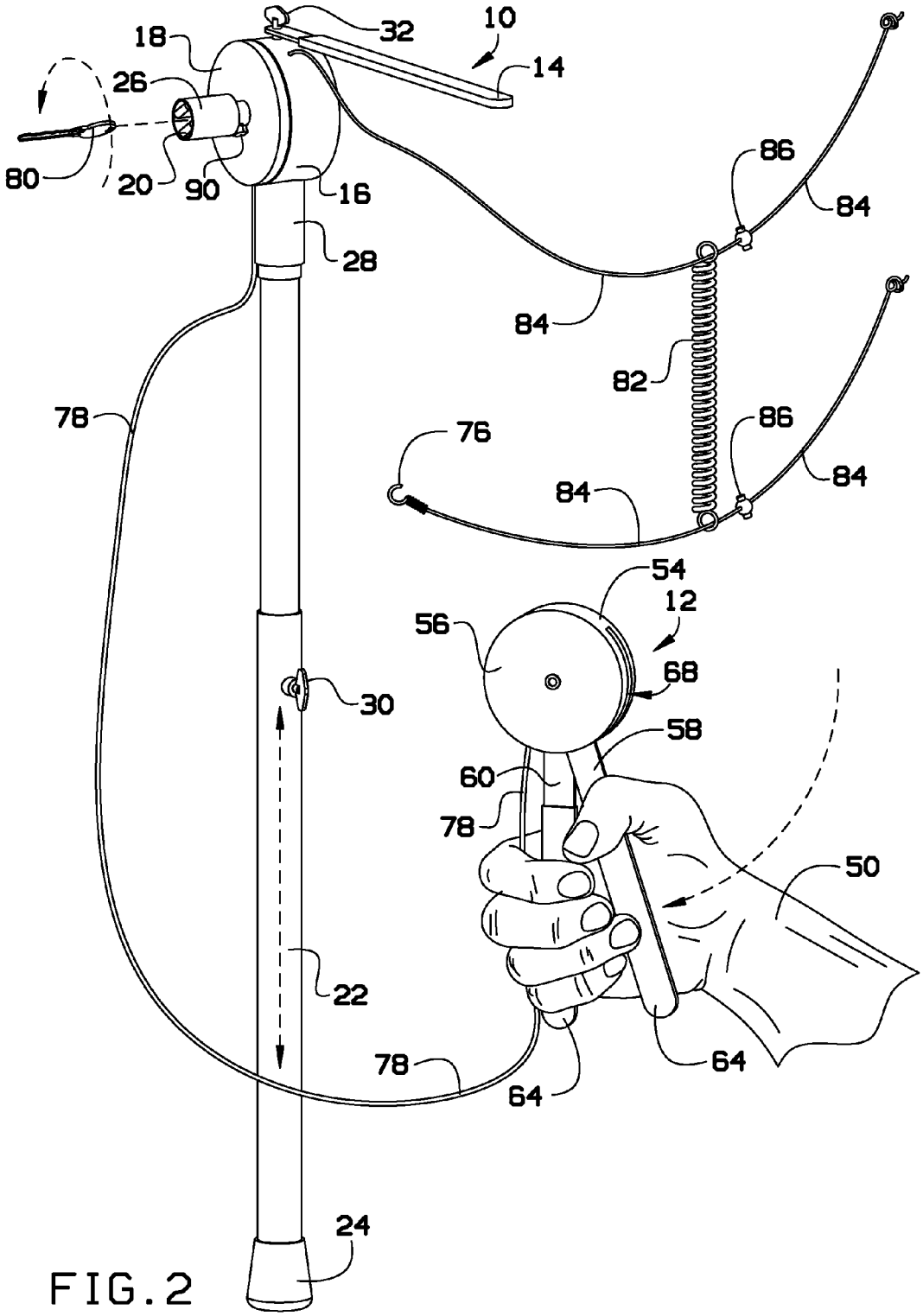
FIG. 2 is a perspective view of the remote ignition key turning device of FIG. 1, showing the device in use by compressing a handheld unit activator-handle, causing rotation of the key twist unit key holder and, subsequently, a key.

The control handle 12 includes handles 58, 60 that can be moved from an initial state (FIG. 1) to an active state (FIG. 2). As the handles 58, 60 are moved together, the cable 52 moves within the sleeve 78 and causes the key holder 20 to turn the key 80. The handles 58, 60 may be coated with a grip 64 for user convenience. Typically, the handles 58, 60 may include a stationary handle 60 and an actuating handle 58. A return spring 46 urges the key holder to turn to an off position when the operator 50 moves the handles 58, 60 apart (from the active to the initial state). The control handle 12 can include a hand held unit case 54 and a cover plate 56. A slot 68 can be provided in the case 54 to permit movement of the actuating handle 58.

Figure 3:
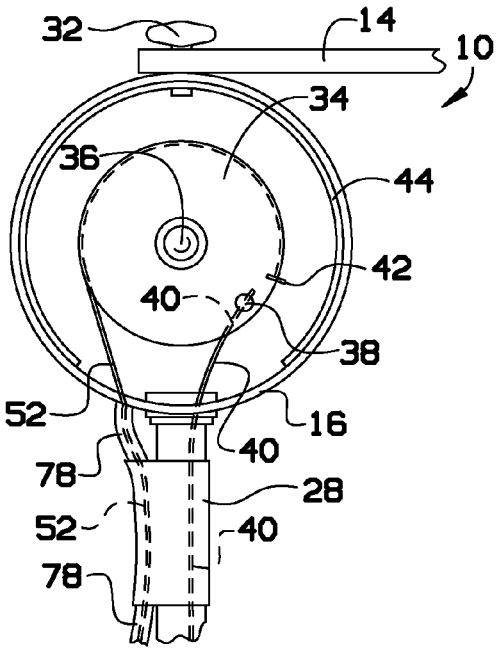
FIG. 3 is a front detail view of the remote ignition key turning device without its pulley cover plate, showing the initial state as depicted in FIG. 1.
Figure 4:
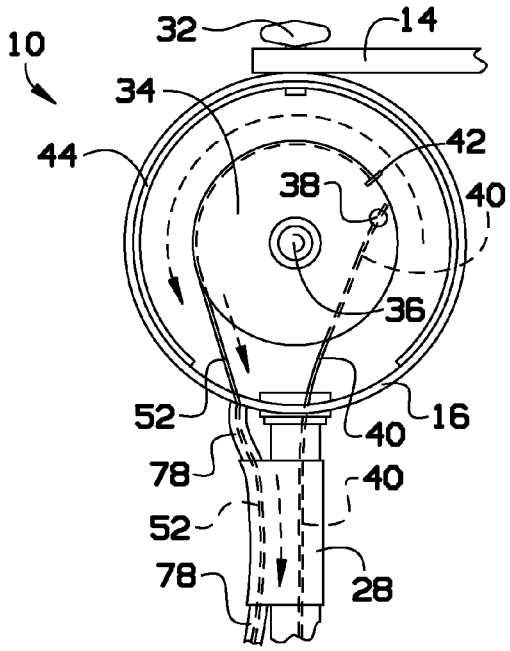
FIG. 4 is a front detail view of the remote ignition key turning device, without its pulley cover plate, showing the device in use, as depicted in FIG. 2.
Figure 5:
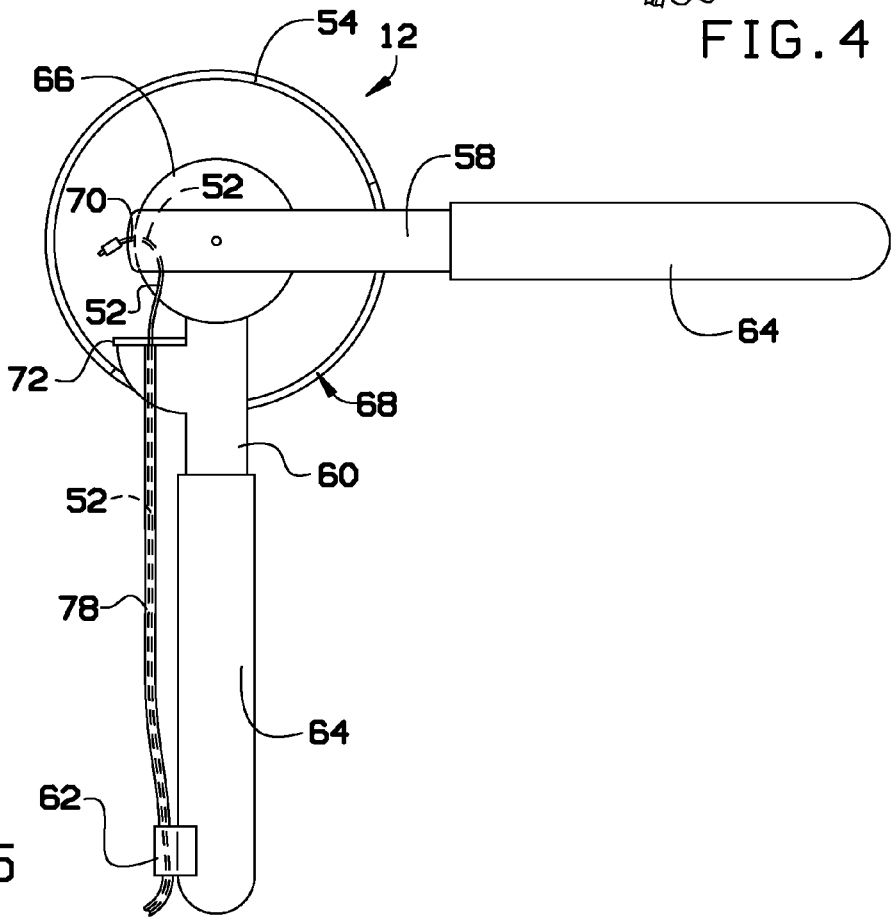
FIG. 5 is a front detail view of the hand held unit illustrated without its cover plate, shown in the initial state as depicted in FIG. 1.
Figure 6:
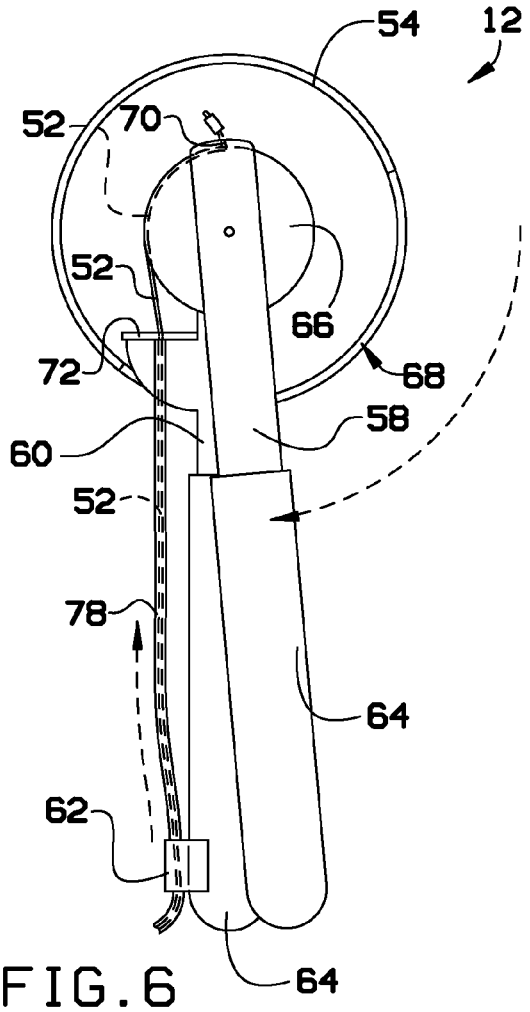
FIG. 6 is a front detail view of the hand held unit illustrated without its cover plate, shown in an active, in use state, as depicted in FIG. 2.
Figure 7:
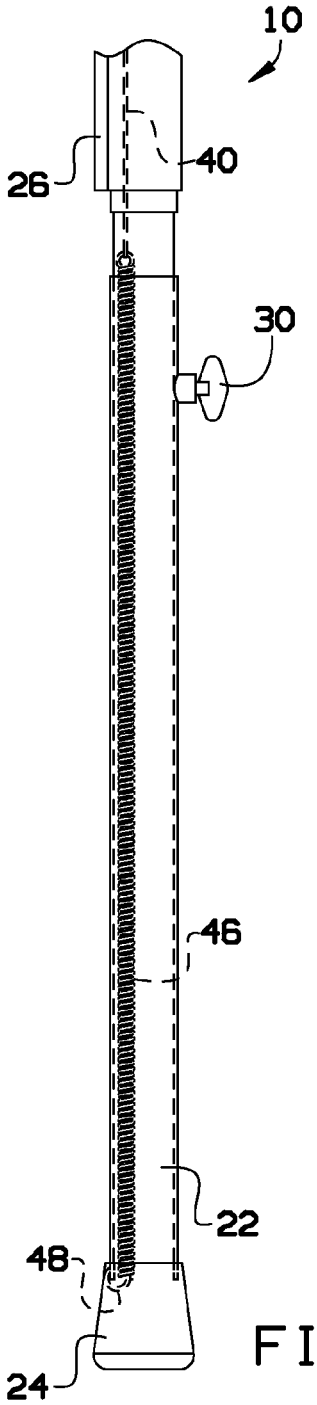
FIG. 7 is a front, partially cut-away view of the remote ignition key turning device of FIG. 1, showing the interior components disposed within its extension rod.
Figure 8:
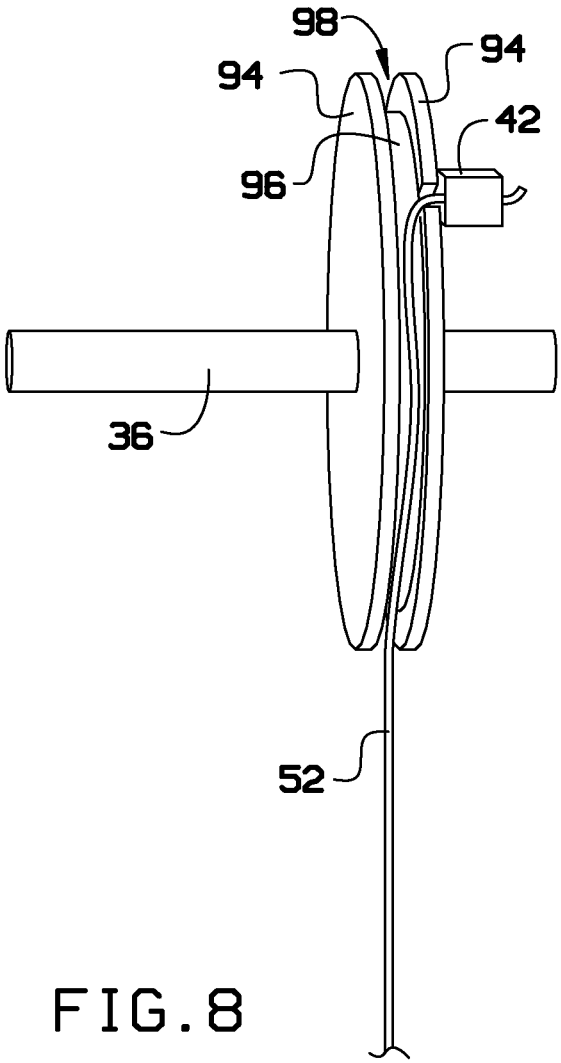
FIG. 8 is a side view of a pulley plate of the remote ignition key turning device of FIG. 1.
Figure 9:
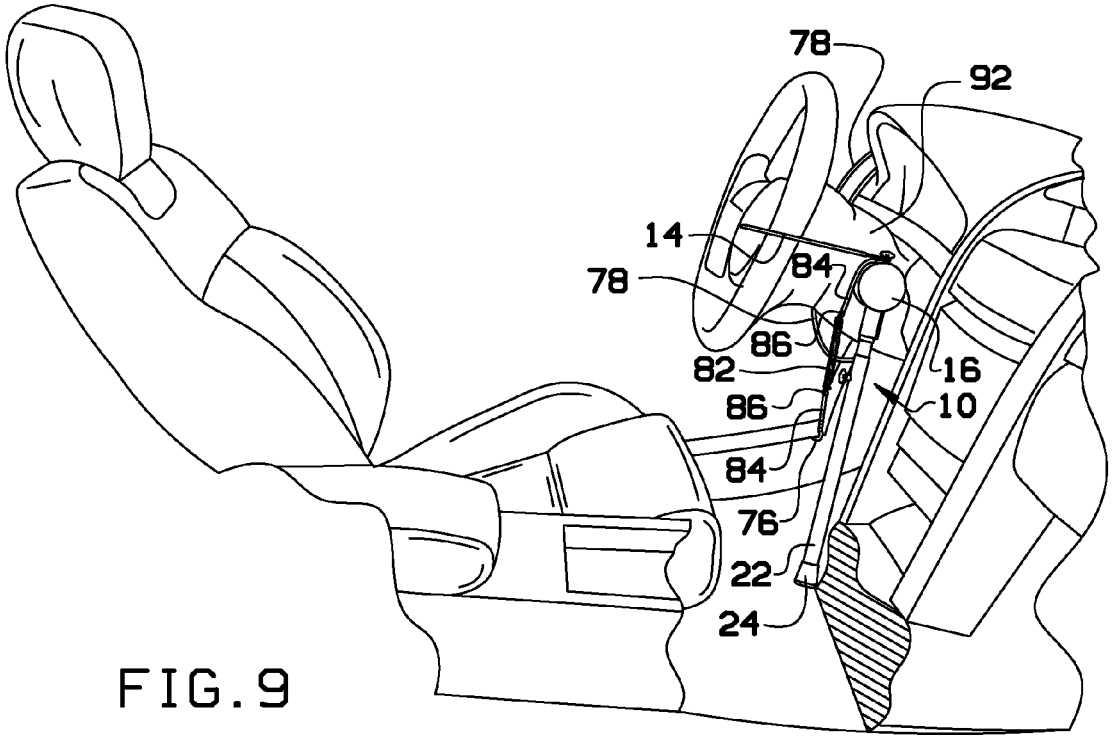
FIG. 9 is a perspective view of the ignition key turning device of FIG. 1, in use in a vehicle.

The key holder 20 can be attached to a shaft 36 extending through a pulley case 16 having a pulley cover plate 18 disposed thereupon. A set screw or bolt 90 can secure the key holder 20 to the shaft 36. The user can loosen the bolt 90 to provide angular adjustment of the key holder 20. An alignment rod 14 can be attached to the pulley case 16 with an alignment rod tension adjustment knob 32. The alignment rod 14 can be used to help align the key turner with the correct pivot angle of the key 80. A pulley case sleeve 44 can be disposed about much of the inner periphery of the pulley case 16 as shown in FIGS. 3 and 4.

The pulley case 16 can attach to an activator cable sleeve 28, which can be attached to an extension rod 22. An extension rod tension adjustment knob 30 can be used to allow adjustment of the extension rod 22. A slip-resistant foot, such as a rubber foot 24 can be disposed on a distal end of the extension rod 22.

A pulley return tension cable 40 can attach to the pulley plate 34 with, for example, a pulley plate return tensioned cable anchor 38. The pulley return tension cable 40 can extend into the extension handle 22 via the activator cable sleeve 28. A return tension cable spring 46 can be disposed in the extension handle 22 to provide tension on the pulley return tension cable 40. The spring 46 can attach to the extension handle 22 with a return tension cable spring hook 48, for example. The tension of the spring 46 can be sufficient to turn the key 80 into an off position when the handles 58, 60 of the hand held control unit 12 are moved apart (back to their initial state).

One end of the cable 52 can be attached to a hand held unit pulley plate 66 with, for example, an anchor point 70. The cable 52 can be disposed in a notch 98 in the outer periphery of the pulley plate 66. A cable stop plate 72 can limit the movement of the cable 52. The cable sleeve 78 can be attached to the stationary handle 60 with, for example, a cable guide clip 62. The notch 98 can be formed between two outer plates 94. In some embodiments, the outer plates 94 can be formed similar to large washers that sandwich smaller washers 96 to form the notch 98.

The other end of the cable 52 can attach to the pulley plate 34 in the pulley case 16. A pulley plate shaft 36 can attach to the key holder 20 such that when the pulley plate 34 turns, the pulley plate shaft 36 turns the key holder 20. A pulley activator cable anchor point 42 can secure the cable 52 to the pulley plate 34.

A spring 82 disposed between two securement cables 84 with cable adjustment clips 86 and a securement cable hook 76 can be used to apply a pressure to push on keys that require pushing into the ignition for use. For example, with keys on the steering column 92, the cable hook 76 can be attached to the emergency brake lever or plastic carpet trim or a door hinge, or the like, to apply pressure to the key into the ignition of the vehicle. With keys on the dash, the cable hook 76 may be connected to the brake pedal to provide pressure to the key into the ignition of the vehicle. The spring 82 and securement cables 84 can also help stabilize the pulley case 16. When combined with the alignment arm 14 and the extension rod 22, a stable three-point system can be used to position the device to properly align the key.

Various methods can be used to make the device of the present invention. Various methods of attachment and securing and aligning could be used. The tool could be made of various materials, such as metal, plastic, composite, fiberglass, carbon fiber, wood, and the like. The tool could be made in various sizes, depending on the specific user application.

The key holder assembly can be made in various shapes and sizes. In some embodiments, the key holder 20 can include arms that can resiliently flex to secure various shapes and sizes of keys. In some embodiments, the tool can include replaceable key holders 20 that can be interchanged in the tool depending on the key used.

Various design modifications may be contemplated within the scope of the present invention. For example, different types of cables, controllers, key holders, alignment rods, and the like, can be used.

It should be understood, of course, that the foregoing relates to exemplary embodiments of the invention and that modifications may be made without departing from the spirit and scope of the invention as set forth in the following claims.

What is claimed is:

1. A remote ignition key turning device comprising:

a key holder;

a pulley plate connected to the key holder wherein rotation of the pulley plate causes rotation of the key holder;

a cable having a first end disposed about an outer periphery of the pulley plate and extending therefrom;

a hand held control unit having a hand held unit pulley plate secured to a second, opposite end of the cable;

a first handle of the hand held control unit attached to the hand held unit pulley plate;

a second handle of the hand held control unit attached to a case of the hand held control unit; and a resilient pulling mechanism attached to the pulley plate, the resilient pulling mechanism applying a force to turn the pulley plate in a first rotational direction, wherein moving the first handle toward the second handle causes the cable to be pulled, thereby turning the pulley plate in a second, opposite rotational direction against the force of the resilient pulling mechanism.

2. The remote ignition key turning device of claim 1, further comprising an extension rod supporting the pulley plate disposed in a pulley case.

3. The remote ignition key turning device of claim 2, wherein the resilient pulling mechanism includes a spring disposed in the extension rod, the spring connected to the pulley plate via a pulley return tension cable.

4. The remote ignition key turning device of claim 1, further comprising an alignment rod attached to a pulley case disposed about the pulley plate.

5. The remote ignition key turning device of claim 1, further comprising a key holder sleeve disposed about the key holder.

6. The remote ignition key turning device of claim 2, further comprising a slip resistant foot disposed on a distal end of the extension rod.

7. The remote ignition key turning device of claim 1, further comprising a cable sleeve disposed over the cable.

8. The remote ignition key turning device of claim 2, further comprising an activator cable sleeve interconnecting a pulley case with the extension rod.

9. The remote ignition key turning device of claim 1, further comprising a securement cable and a securement spring.

10. A remote ignition key turning device comprising:

a key holder;

a pulley plate connected to the key holder wherein rotation of the pulley plate causes rotation of the key holder;

a cable having a first end disposed about an outer periphery of the pulley plate and extending therefrom;

a hand held control unit having a hand held unit pulley plate secured to a second, opposite end of the cable;

a first handle of the hand held control unit attached to the hand held unit pulley plate;

a second handle of the hand held control unit attached to a case of the hand held control unit;

an extension rod supporting the pulley plate disposed in a pulley case;

an alignment rod attached to the pulley case disposed about the pulley plate; and a pulley return tension cable attached to the pulley plate, the pulley return tension cable attached to a spring disposed in the extension rod, the spring applying a force to turn the pulley plate in a first rotational direction, wherein moving the first handle toward the second handle causes the cable to be pulled, thereby turning the pulley plate in a second, opposite rotational direction against the force of the spring.

11. The remote ignition key turning device of claim 10, further comprising a slip resistant foot disposed on a distal end of the extension rod.

12. The remote ignition key turning device of claim 10, further comprising a cable sleeve disposed over the cable.

13. The remote ignition key turning device of claim 10, further comprising an activator cable sleeve interconnecting the pulley case with the extension rod.

14. The remote ignition key turning device of claim 10, further comprising a securement cable and a securement spring.

* * * * *